US009043010B2

(12) United States Patent
Boegl et al.

(10) Patent No.: US 9,043,010 B2
(45) Date of Patent: May 26, 2015

(54) METHOD AND WEAVING MACHINE FOR SHEDDING

(75) Inventors: Gerhard Boegl, Nueziders (AT); Michael Cramer, Lindau (DE)

(73) Assignee: Lindauer DORNIER Gesellschaft mbH, Lindau (DE)

( * ) Notice: Subject to any disclaimer, the term of this patent is extended or adjusted under 35 U.S.C. 154(b) by 0 days.

(21) Appl. No.: 14/003,282

(22) PCT Filed: Feb. 14, 2012

(86) PCT No.: PCT/EP2012/052529

§ 371 (c)(1),
(2), (4) Date: Sep. 5, 2013

(87) PCT Pub. No.: WO2012/130519

PCT Pub. Date: Oct. 4, 2012

(65) Prior Publication Data

US 2013/0340881 A1 Dec. 26, 2013

(30) Foreign Application Priority Data

Mar. 29, 2011 (DE) ..... 10 2011 006 368

(51) Int. Cl.
*G06F 19/00* (2011.01)
*D03C 13/00* (2006.01)
*D03C 1/14* (2006.01)
(Continued)

(52) U.S. Cl.
CPC ..... *D03C 13/02* (2013.01); *D03C 1/146* (2013.01); *D03D 51/02* (2013.01); *D03C 1/16* (2013.01)

(58) Field of Classification Search
USPC ..... 700/140; 139/1 R, 55.1
See application file for complete search history.

(56) References Cited

U.S. PATENT DOCUMENTS 4,572,247 A 2/1986 Speich
5,617,901 A * 4/1997 Adriaen et al. ..... 139/1 R
5,642,757 A 7/1997 Froment et al.
(Continued)

FOREIGN PATENT DOCUMENTS

CN 1636088 A 7/2005
CN 1675420 A 9/2005
(Continued)

OTHER PUBLICATIONS

International Search Report of the International Searching Authority for International Application PCT/EP2012/052529, mailed Apr. 17, 2013, 2 pages, European Patent Office, HV Rijswijk, Netherlands.
(Continued)

*Primary Examiner* — Nathan Durham
(74) *Attorney, Agent, or Firm* — W. F. Fasse

(57) ABSTRACT

Shed formation on a weaving machine (2), which is driven by a main motor (3), with a shedding device (4), which is driven by a shedding motor (5), wherein in each motion cycle (N) of the weaving machine (2), a loom shed (7) formed by warp threads (8) of the weaving machine (2) is opened and closed dependent on a weave pattern, and wherein the synchronicity of the two motors (3, 5) is controlled by signals (10) of a control device (9). During a partial number (Tn1, Tn2) of motion cycles (N), the synchronicity of the two motors (3, 5) is changed in such a manner so that plural shed closure angles (FSW) at which the loom shed (7) in the respective motion cycles (N) is closed, form an increasing or decreasing sequence.

11 Claims, 5 Drawing Sheets

(51) Int. Cl.
*D03D 51/02* (2006.01)
*D03C 1/16* (2006.01)

(56) References Cited

U.S. PATENT DOCUMENTS

| | | | | |
|---|---|---|---|---|
| 5,743,305 | A * | 4/1998 | Tamura et al. | 139/55.1 |
| 6,307,340 | B1 | 10/2001 | Wagner et al. | |
| 6,532,996 | B2 | 3/2003 | Tamura | |
| 6,953,063 | B2 | 10/2005 | Krumm et al. | |
| 6,962,171 | B2 | 11/2005 | Krumm et al. | |
| 7,114,527 | B2 | 10/2006 | Von Zwehl et al. | |
| 7,341,077 | B2 | 3/2008 | Sampers | |
| 2004/0031533 | A1 | 2/2004 | Krumm et al. | |

FOREIGN PATENT DOCUMENTS

| | | | |
|---|---|---|---|
| CN | 101072906 | A | 11/2007 |
| DE | 200 21 049 | | 5/2001 |
| DE | 100 53 079 | | 5/2002 |
| DE | 101 61 789 | | 7/2003 |
| EP | 0 010 267 | | 4/1980 |
| EP | 0 107 099 | | 5/1984 |
| EP | 1 065 306 | | 1/2001 |
| EP | 1 541 728 | | 6/2005 |
| JP | 09-078388 | A | 3/1997 |
| WO | WO 03/071017 | | 8/2003 |
| WO | WO 2004/092467 | | 10/2004 |
| WO | WO 2006/039912 | | 4/2006 |

OTHER PUBLICATIONS

PCT International Preliminary Report on Patentability including English Translation of PCT Written Opinion of the International Searching Authority for International Application PCT/EP2012/052529, issued Oct. 2, 2013, 9 pages, International Bureau of WIPO, Geneva, Switzerland.

Chinese Search Report dated May 12, 2014, in Chinese Patent Application No. 201280016194.3, 2 pages; with partial English (and partial German) translation, 2 pages.

Chinese Office Action issued May 20, 2014 in Chinese Patent Application No. 201280016194.3, 5 pages; with partial English (and partial German) translation, 10 pages.

* cited by examiner

METHOD AND WEAVING MACHINE FOR SHEDDING

FIELD OF THE INVENTION

The present invention relates to a method and a weaving machine for loom shed formation with a shedding device that is driven by its own shedding motor.

BACKGROUND INFORMATION

For loom shed formation or shedding in weaving machines it is known in the prior art to provide a shedding device in which several shedding elements, which each respectively guide a warp thread sheet or group, are driven to move upwardly and downwardly via an intermediate transmission from the main drive motor of the weaving machine. In this manner a loom shed, which is formed by the warp thread sheets of different shedding elements, is alternately opened and closed. A weft thread is inserted into the opened loom shed. After the weft insertion, the loom shed is closed and then again opened with the aid of the shedding elements. Simultaneously the weft thread is beat-up against a fabric edge by a weaving reed and the process begins anew. A weave design or pattern is formed by the shed changes of the various different warp thread sheets and the insertion of different weft threads.

When closing and subsequently opening the loom shed it occurs that individual warp threads of neighboring warp thread sheets get caught or tangled or hung-up on one another. No loom shed is formed between these warp threads. In the subsequent weft insertion, these so called sticking or jammed or tangled warp threads cause interferences. In the weft insertion by means of mechanical elements, for example a gripper, the sticking warp threads are destroyed or broken by the weft insertion element, the weaving machine stops automatically due to warp break. In the weft insertion by means of a fluid jet, for example compressed air, the weft thread gets caught or hung up on the sticking warp threads. This leads to an automatic shut-down of the weaving machine due to weft break. Weft break and warp break lead to standstill times or down times of the weaving machine and make interventions by the personnel necessary. Therefore efforts are being made to prevent the sticking or tangling or jamming of warp threads. This is achieved, for example, in that the time points at which the loom shed is closed are prescribed differently for different neighboring warp thread sheets. Thereby it is achieved that all upwardly and downwardly moving warp threads do not encounter one another at the same time point in the closed loom shed, but rather that this encountering or meeting of warp thread sheets that are guided by different shedding elements takes place at different time points in the motion cycle of the weaving machine. However, in the prior art there are shedding devices for which this is not possible, because all shedding elements always simultaneously move through the shed closed position (loom shed closed) due to structural or constructive reasons.

The time point at which the shed closed position is run through can be changed in most shedding devices in that the connection between the main motor of the weaving machine and the shedding device driven from this main motor is released and then again connected after a turning or twisting of one of the two drive shafts. Thereby, the relative shed closure time point for all shedding elements and thus for all warp threads in the loom shed is changed within the motion cycle of the weaving machine. Such an adjustment of the relative shed closure time point for all shedding elements simultaneously can be carried out without mechanical intervention, that is to say also with a running weaving machine, in shedding devices that are driven by their own shedding motor. Such a change of the synchronicity between the main motor of the weaving machine and the shedding motor of the shedding device is carried out with the aid of electronic control signals of a control device of the weaving machine.

A weaving machine with the mentioned devices, which permit the changing of the synchronicity on a running weaving machine, is shown by the WO2003071017 A for example. In this document it is explained that with such a machine it is basically or fundamentally possible to flexibly arrange or establish the tuning or adaptation of the operating relationship of the weaving machine and the shedding device or shedding machine corresponding to the weaving requirements, that is to say to select within broad boundaries the synchronicity of both drive systems with respect to the basic or ground tuning or adaptation (e.g. shed closure at what weaving machine position angle) and with respect to the permissible tolerances. Furthermore, the WO2003071017 A discloses that the drive of the weaving and shedding machine is driven synchronously at a prescribed point, weaving cycle for weaving cycle. This point can be different weaving cycle for weaving cycle.

When working with such a weaving machine it has been determined in a surprising manner, that the problems described above in the introduction due to sticking or jamming warp threads can be reduced by certain or particular changes of the synchronicity on a running weaving machine.

SUMMARY OF THE INVENTION

It is an object of an embodiment of the present invention to provide a method and a weaving machine with which the above improvement can be achieved.

The above object can be achieved by at least one embodiment of a method and a weaving machine as set forth herein. The method according to an embodiment of the invention provides the loom shed formation by means of a shedding device that is driven by a shedding motor and that is mounted or arranged on a weaving machine that is driven by a main motor. A loom shed formed from plural warp threads or plural warp thread sheets of the weaving machine is opened and closed dependent on a binding or weave pattern in each motion cycle of the weaving machine with a running shedding device. In that regard, the binding or weave pattern can be prescribed, for example, in the form of drive means, by means of hole-punched cards or alternatively electronically by data stored in the control arrangement. In that regard, the drive means can be embodied, for example, as an intermediate transmission with plural different cam discs or as an intermediate transmission with plural electromechanical switching elements which are actuated during each motion cycle in such a manner so that shedding elements connected thereto raise or lower the warp threads according to the desired binding or weave pattern. In that regard, the binding or weave pattern contains informations about which warp threads or warp thread sheets are positioned, by the shedding device, in the upper shed or in the lower shed, that is to say above or below the weft thread to be inserted, during a motion cycle of the weaving machine.

The two motors for the drive of the weaving machine and the shedding device are synchronized with one another via the electronic control arrangement of the weaving machine in such a manner so that the loom shed is opened at the time point of the weft insertion of the weaving machine. However, the synchronicity of the two motors can be changed by control signals of a control device on the running weaving machine. Thereby it is achieved that during different motion cycles of the weaving machine, the relative shed closure time points, at which the loom shed is closed in the respective motion cycles, are different from one another.

The term of the relative shed closure time point here represents or sets forth the time point as of the beginning of a motion cycle of the weaving machine. Because a motion cycle is typically defined by a complete rotation of the weaving machine main shaft, one can also specify the shed closure time point in relation to this rotation of the weaving machine main shaft running through 360°. Then one speaks of a shed closure angle instead of a relative shed closure time point. This shed closure angle is a value that can be input on the operating console of the weaving machine into the electronic weaving machine control arrangement or can be read-in via a data carrier with pattern data. Beginning and end of a motion cycle or of a 360° rotation of the weaving machine main shaft is typically measured beginning from a weaving reed beat-up. Between two weaving reed beat-ups, that is to say within one motion cycle, respectively one weft insertion takes place. The use of the shed closure angles, which refer or relate to a rotation (=360°) of the weaving machine main shaft and which are thus independent of the rotational speed, leads to a better oversight and is therefore preferred here.

The method according to an embodiment of the invention is characterized in that the shed closure angles form an increasing or decreasing sequence of shed closure angles over a prescribed partial number of motion cycles of the weaving machine. This occurs by correspondingly changing the synchronicity of the two motors. As mentioned above, methods for changing this synchronicity by control signals are known to a skilled worker in the art. For carrying out the method according to an embodiment of the invention, a control program that is adapted to carrying out the method is needed in the control arrangement, with the aid of which the synchronicity of the motors is changed so that the increasing and decreasing sequences of shed closure angles according to the invention arise. The successive relative shed closure angles according to the invention form either increasing sequences, in which during the prescribed partial number of successive motion cycles in several of these motion cycles the shed closure angle lies after the shed closure angle of all previous motion cycles within this partial number, or they form decreasing sequences, in which during the prescribed partial number of successive motion cycles in several of these motion cycles the shed closure angle lies before the shed closure angle of all previous motion cycles within this partial number.

It is advantageous when these increasing and decreasing sequences of shed closure angles follow one another in a short time on a running weaving machine, so that a second partial number with a decreasing sequence within a total number of motion cycles directly follows a first partial number with increasing sequence, or vice versa.

In tests it has been shown that the tendency of the warp threads to become stuck can be reduced by this continuous increasing and decreasing change of the shed closure angle in the steady or static weaving process. Processes during the run-up and during the braking slow-down of weaving machines and shedding devices are not taken into consideration in an embodiment of the present invention. By the method according to an embodiment of the invention it is prevented, that during the weaving process over a long time, all warp threads become stuck or tangled in a parallel shedding motion that is uniformly repeated. Thus, the position of the warp thread sheets in the weaving machine is different in each shed closing process, that is to say in each approaching or meeting of the upwardly and downwardly moving neighboring warp thread sheets. Moreover, the shed opening at the time point of the weaving reed beat-up is constantly changed. That means, that at this time point in different motion cycles, the warp thread sheets take up different paths within the weaving machine from the warp beam to the fabric edge. During the weaving read beat-up, a tension increase takes place in the warp threads, which is constantly a different one with a constantly changing shed closure angle.

In this method in principle it is of no consequence whether the shedding device is slowed down or the weaving machine is accelerated for advancing the relative shed closure time point or shed closure angle from one motion cycle to the next. For a later shed closure angle, thus an increasing sequence, the reverse pertains. A combination of accelerating or respectively retarding or slowing-down both machines is also conceivable.

In practice in carrying out the method according to an embodiment of the invention it has been found that on fast-running weaving machines, even a slow increase or decrease of the sequences of the shed closure angles over more than 100 motion cycles leads to the desired result. It is especially advantageous, however, if the total number of motion cycles within which the increasing or decreasing sequences of shed closure angles lie, does not amount to more than 100. On slower running machines, however, a total number of not more than 50 motion cycles is also usable, within which the two partial sequences with the respective first and second partial numbers of motion cycles follow one another. The correct magnitude or value of the total number and the respective partial numbers are dependent on the type of the woven fabric, the number of the shedding elements and the rotational speed at which the weaving machine and the shedding device are driven. At higher rotational speeds and larger masses to be accelerated in the machines driven by the two motors, a greater number of motion cycles will be necessary for such an increasing and decreasing sequence of shed closure angles. That is due to the fact that the additional energy that is necessary for accelerating one of the two machines during the change of the synchronicity shall not take on too large values. In any case it is sensible or applicable to store, in an intermediate circuit of the control device, the energy that is released during the retarding or slowing-down of one of the two machines, and to again use this energy for the subsequent acceleration.

In carrying out the method according to an embodiment of the invention it is possible in principle, that in each motion cycle the shed closure angle is different from the shed closure angle of the previous motion cycle. However, it can also already be sufficient for the intended effect, if the shed closure angles increase or decrease in the manner of a ramp over a certain number of motion cycles that do not all need to be directly successive after one another. It has been determined that it is advantageous if, within the partial number, the number of the motion cycles in which the ramp for the shed closure angle increases or decreases, includes more than two motion cycles. In most cases three to fifteen motion cycles are provided, in which the shed closure angle is changed relative to the preceding one. Between motion cycles in which the shed closure angle is changed relative to the preceding one, there can also be such motion cycles in which the shed closure angle is not changed relative to the preceding one.

In weaving machines it is known in the prior art to select the relative shed closure time points or shed closure angles of a shedding device that is driven by its own shedding motor, in such a manner so that a changed shed closure angle is adjustedly set by control signals in connection with changes of the binding or weave pattern. The change of the shed closure angle occurs at the transition from a first binding sequence formed by several successive binding or weave patterns to a second binding sequence formed by other binding or weave patterns. Before and after the change of the shed closure angle, the respective binding sequences have different binding or weave patterns.

The method according to an embodiment of the invention is set up so that defined changes of the shed closure angle are predominantly determined by mechanical parameters of the weaving machine and of the shedding machine. In one embodiment of the method according to the invention it is therefore provided to prescribe increasing and decreasing sequences of shed closure angles independently of the binding or weave pattern and independently of the binding sequence formed by several binding or weave patterns. That means that the binding sequence can have or include the same binding or weave patterns before the increasing or decreasing sequence of shed closure angles as after the increasing or decreasing sequence of shed closure angles. For weave designs in which the binding patterns of several successive motion cycles form a binding sequence, which define a pattern repeat that repeats over short distances, the partial number of motion cycles in which several shed closure angles form an increasing or decreasing sequence can even be greater than the number of the motion cycles that define a pattern repeat.

It has also be found to be sensible or applicable in terms of the weaving technology, to provide an adaptation of the shed closure angle to the respective weft yarn or thread to be inserted. However, the method according to an embodiment of the invention can also be carried out without consideration of the weft sequence of various different weft yarns or threads.

In a weaving machine according to an embodiment of the invention, a control program is provided, that is adapted for carrying out the method according to an embodiment of the invention; and if applicable special control devices are still additionally necessary in order to convert the commands of the control program into signals to the motors. Also advantageous is a suitably adapted input device, for example with a display screen and keyboards or keypads, or with menu fields, which can be selected via touch contact with the screen. Therewith, in an advantageous embodiment, one or more values for specifying the increasing or decreasing sequences of shed closure angles according to an embodiment of the invention can be prescribed. Those can be values for a partial number of motion cycles, in which several shed closure angles form an increasing or decreasing sequence; if applicable a first and a second partial number can be input independently from one another. Also possible is the input of an initial value and/or an end value of the shed closure angle of the increasing or decreasing sequence of shed closure angles together with a step width that defines the difference of the shed closure angles between two successive motion cycles.

The operator of a weaving machine is accustomed to prescribing the time points at which the loom shed is closed within a motion cycle, as the shed closure angles. Therefore, it is advantageous if devices or input means are provided, with which the starting is and/or end value for an increasing or decreasing sequence of relative shed closure time points can be prescribed in that the shed closure angle of the weaving machine main shaft associated with the respective value of the relative shed closure time point can be prescribed. Also possible are embodiments in which, within the prescribed partial number, the number of the motion cycles in which the shed closure angle relative to the respective previous motion cycle is changed, is prescribed by the operator via the input device. Prescribing the total number of motion cycles, which includes both a partial number of shed closure angles in increasing sequence as well as a partial number of shed closure angles in decreasing sequence, is also carried out if applicable via the suitably adapted input device.

Values for partial or total numbers of motion cycles or for beginning and end values and/or step widths of the increasing or decreasing sequences can either be prescribed completely by the operator, or can also be permanently programmed into the control arrangement. It is also advantageous that the increasing and decreasing sequences of shed closure angles or relative shed closure time points are calculated by a suitably adapted control program dependent on a nominal rated value or average value for a shed closure angle that is best suited for the respective woven fabric. In that regard, the nominal rated value or average value is prescribed by the operator or is loaded or read into the control arrangement together with other data that are necessary for the production of the current woven fabric. In an advantageous embodiment of the weaving machine according to the invention, the suitably adapted control program includes functions by which the control program calculates the values that are not prescribed by the operator and that are necessary for carrying out the method according to this embodiment of the invention. In that regard, both values of the already mentioned type that are desired for carrying out the method and that are already input by the operator, as well as values that are input or stored in the control arrangement and that are dependent on mechanical or weaving-technical parameters, e.g. rotational speed, machine width/mass, number of shedding elements, type and number of the warp threads, can be taken into consideration.

It is also conceivable that the data necessary for carrying out the method according to an embodiment of the invention are read or loaded into the control device either partially or completely via a data carrier. Individual or several ones of the data for carrying out the method according to an embodiment of the invention, which have been input, calculated or read-in, can be displayed on the input device as needed and again changed manually by the operator.

Such ramps or sequences of increasing or decreasing shed closure angles can also be used in a targeted manner in order to achieve certain optical effects in the woven fabric. In woven fabrics of which the optical fabric or weave appearance is clearly visibly changed by changes of the shed closure angle, structures with stripes or bands that extend in the weft direction can be achieved in a targeted manner with the method according to an embodiment of the invention.

BRIEF DESCRIPTION OF THE DRAWINGS

In the following an example embodiment of the invention will be explained in detail in connection with the Figures.

DETAILED DESCRIPTION OF EXAMPLE EMBODIMENTS OF THE INVENTION

Figure 1:
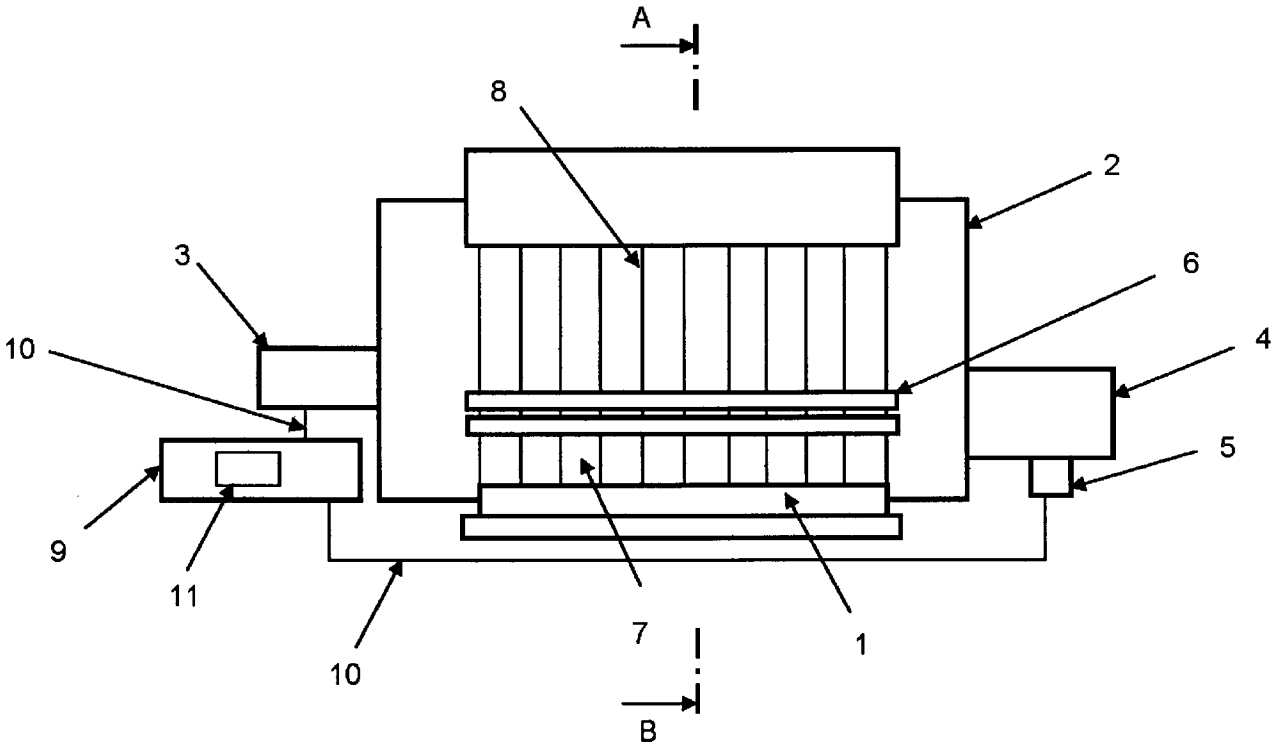
FIG. 1 shows a weaving machine with shedding device, in a schematic view from the top.
Figure 2:
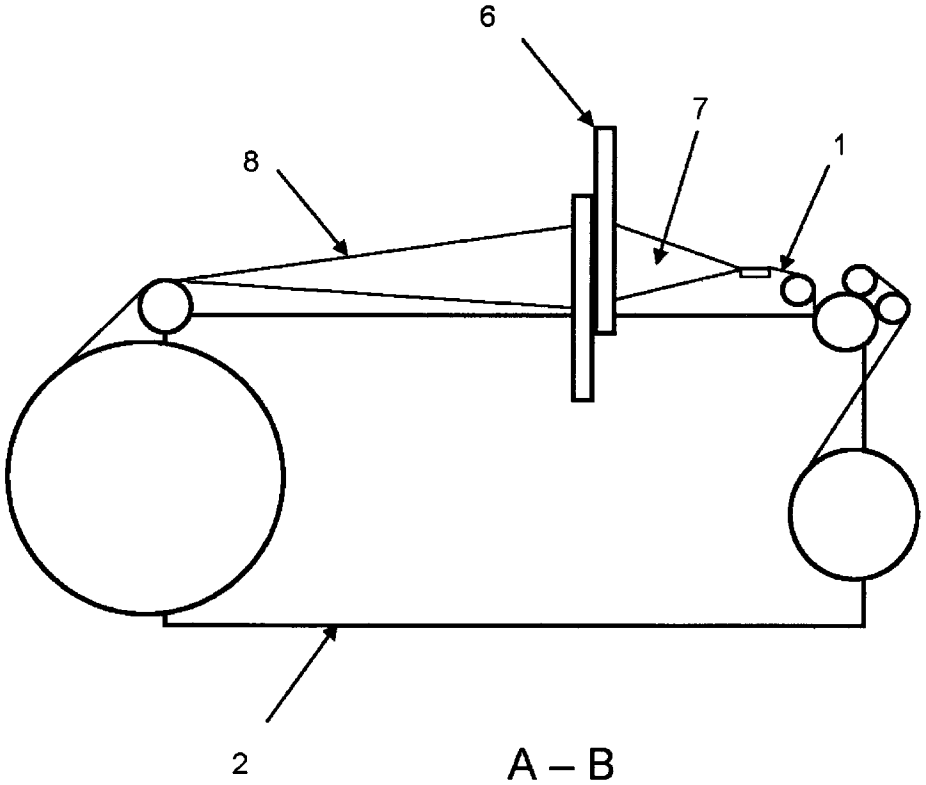
FIG. 2 shows a weaving machine with shedding device, in a schematic sectional view A-B.

The FIGS. 1 and 2 show a weaving machine 2 with a main motor 3, a shedding device 4 and a shedding motor 5. The warp threads 8 are guided by shedding elements 6. These are driven by the shedding device 4 to move upwardly and downwardly, so that a loom shed 7 is formed by the warp threads 8. A weft thread is inserted (not shown) into the opened loom shed 7 and is beat-up against the woven web or fabric 1 by a weaving read (not shown). A control device 9 is present. This transmits signals 10 for the synchronization to the two motors 3, 5. The control device 9 contains a control program that is suitably adapted to carrying out the method according to the invention. That means, for motion cycles N that are carried out one after another on a running weaving machine 2, increasing or decreasing sequences of relative shed closure time points or shed closure angles FSWn by changing the synchronization between the two motors 3, 5, are calculated with this control program, and the corresponding signals 10 are output to the two motors 3, 5. The calculation of the signals 10 for the synchronization is supported by inputs of the operator on the input device 11 in the present example.

In the example embodiment it is provided that the following values are prescribeable or inputable by the operator of the weaving machine 2 on the input device 11 of the control device 9:

- a starting and ending value for the increasing and decreasing sequences of shed closure angles FSW;
- a step width, which defines the difference of the shed closure angles FSW between two successive motion cycles N.

The values that are not input by the operator but that are nonetheless necessary for carrying out the method are replaced by standard values calculated in the control device 9, or the control device 9 suggests such values to the operator. The control program also determines the maximum permissible limit value for the slope of the increasing and decreasing sequences of shed closure angles FSW. In that regard, mechanical parameters of the weaving machine 2 are taken into account. For that, the control device 9 contains a value for the rotational speed of the running weaving machine 2, which is prescribed by the operator. Dependent on the rotational speed, the slope of the increasing or decreasing sequences of shed closure angles FSWn (see FIG. 4) should not exceed certain values in order not to overload the motors 3, 5.

Figure 3:
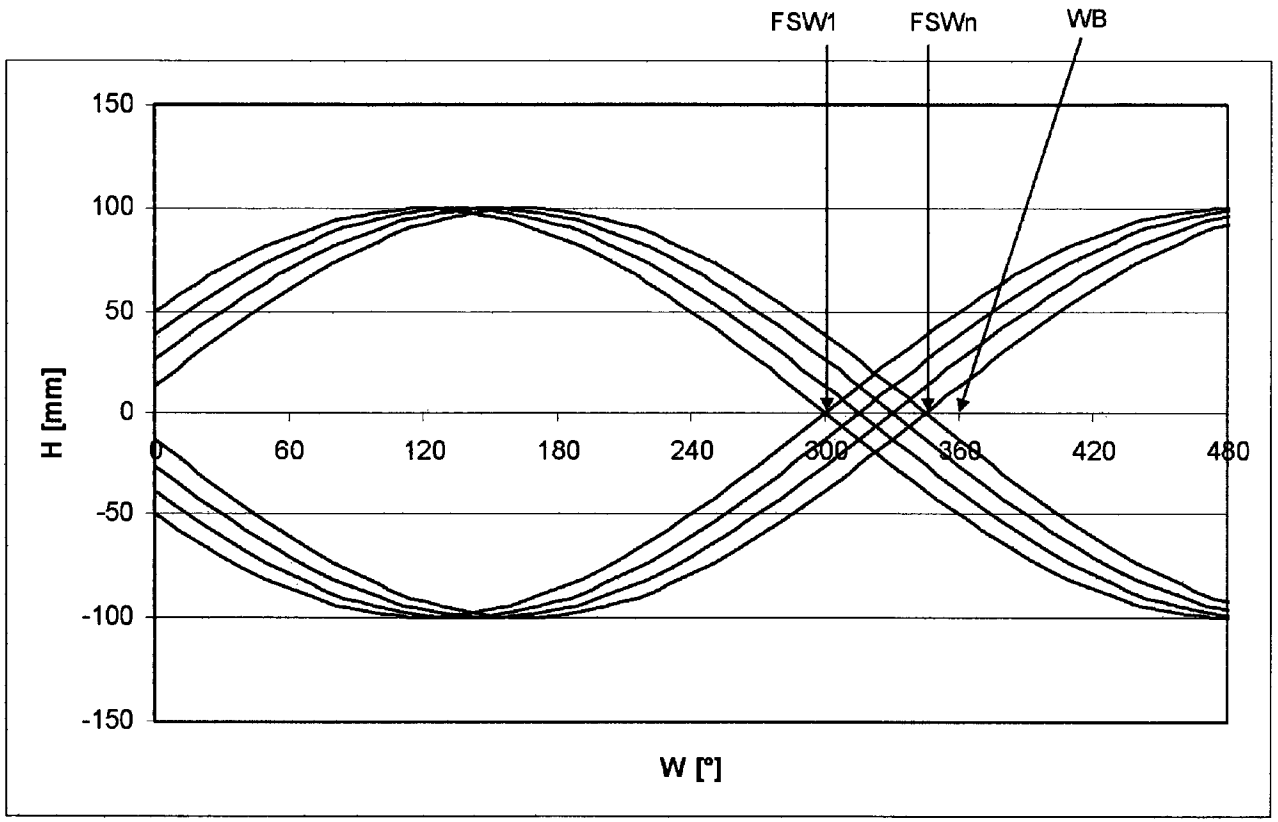
FIG. 3 shows superimposed diagrams of the stroke motion of the shedding elements with different shed closure angles in different motion cycles.

FIG. 3 shows four different diagrams H1, Hn of the loom shed opening with different shed closure angles FSWn. The diagrams show the lift or stroke H of the warp thread sheet 8 between closed shed position (H=0) and open shed position (H=100) over 1.5 rotations or 480 angular degrees W of the weaving machine main shaft. In the range from W=300° to W=360° the stroke curves H1, Hn run through the value H=0 at the respective shed closure angles FSW1 to FSWn. In the range W=20° to W=280°, the loom shed 7 is opened in each case. This time period is available for the weft insertion. At W=WB=360° or 0°, the weft thread is beat-up against the woven web or fabric 1. Which one or ones of the stroke curves H1, Hn with their associated shed closure angles FSWn will be run-through in the respective motion cycle N of the weaving machine 2 depends on the synchronization between the two motors 3, 5 of the weaving machine 2 and the shedding device 4 in the respective motion cycle N. Due to the change of the synchronization on the running machine, motion curves H actually arise, which deviate from the ones illustrated here, because a distortion of the curves is produced at the transition from one shed closure angle FSW1 to the next shed closure angle FSW2. One can also see that the size of the shed opening at the time point of the weaving reed beat-up WB also becomes differently sized due to the change of the shed closure angle FSW.

Figure 4:
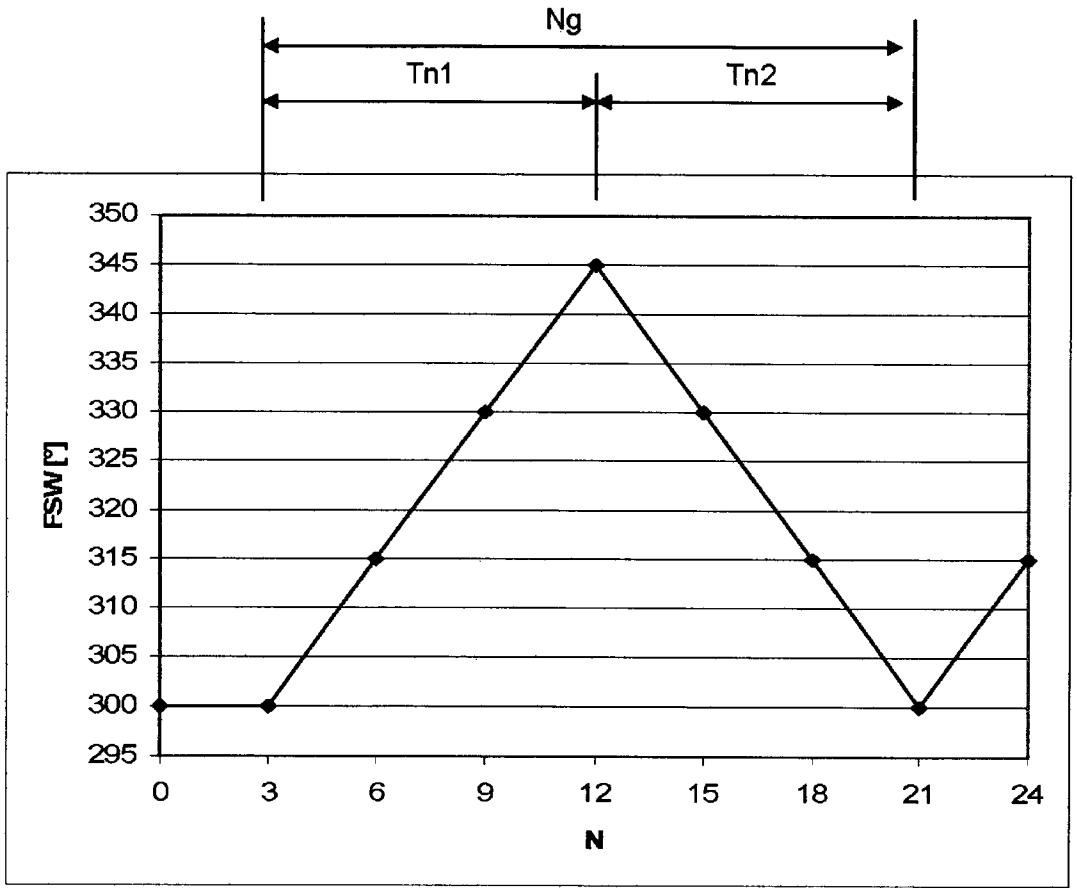
FIG. 4 shows a diagram of the progression of the shed closure angle over several motion cycles of a weaving machine that carries out an example of the method according to the invention.

In FIG. 4, the shed closure angles FSW that belong to the respective motion cycle N are entered for successive motion cycles of the weaving machine 2. In this example embodiment, increasing and decreasing sequences of shed closure angles FSW arise, from which increasing and decreasing sequences of relative shed closure time points arise on the running shedding device 4. In FIG. 4 one can see that a total number Ng of motion cycles contains two partial numbers Tn1 and Tn2. Within the partial number Tn1 successive shed closure angles FSW form an increasing sequence in that the line that connects the points in the diagram rises or increases from a starting value to an end value. In the partial region Tn2 the corresponding line proceeds decreasingly or descending, the shed closure angles FSW in this partial region form a decreasing or descending sequence.

In the illustrated example embodiment, the starting value of the shed closure angle FSW prescribed by the operator amounts to FSW3=300°, and the prescribed end value amounts to FSW12=345°. In the present case the control program is designed and embodied so that the shed closure angle FSW changes within the partial numbers Tn1 and Tn2 in each motion cycle N, and that the partial numbers Tn1 and Tn2 have the same size. Thus, the changes uniformly form increasing and decreasing sequences with the prescribed step width of 5° between two successive motion cycles. From that, calculated partial numbers of Tn1=9=Tn2 arise. Consequently, in the present example embodiment, the total number Ng of the motion cycles, which contains an increasing and a decreasing sequence of shed closure angles FSW, amounts to Ng=18. The control arrangement starts the method sequence illustrated in FIG. 4 at a prescribed time point after the start of the weaving and the shedding machine. This time point is here the motion cycle with the number N=3. However, other time points for starting the method are also possible. Depending on the embodiment, these can be permanently programmed into the control program or can be prescribed by the operator. It can also be provided that the operator switches on or off the method according to the invention on a running weaving machine. By calculated conversion of the diagrams of the shed opening of FIG. 3 into a time axis and by determining the relative shed closure time points on this time axis determined by the weaving machine rotational speed, in a similar manner as in FIG. 4 it would also be possible to form increasing and decreasing sequences of relative shed closure time points instead of sequences of shed closure angles FSW. However, these diagrams would be different for different rotational speeds of the weaving machine 2, and thus would not be so readily usable.

Figure 5:
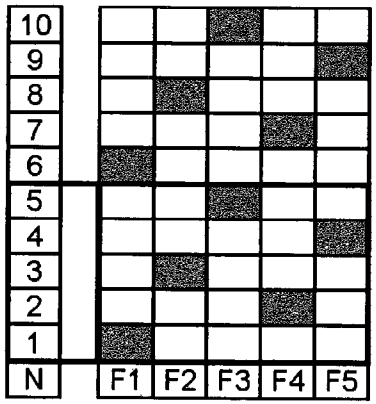
FIG. 5 shows an example of a weave pattern draft with pattern repeat.

FIG. 5 shows a binding sequence of a woven web or fabric over 10 motion cycles. A binding or weave pattern in the form of high or low positions of the warp threads or of the shedding elements F1 to F5 guiding the warp threads, which take part in the loom shed formation, is allocated to each motion cycle N. This is represented in the illustration of a weave pattern draft that is well understood by the skilled worker in the art, wherein dark fields indicate a high position (=upper shed) of the associated warp thread or the associated shedding element. The successive binding or weave patterns can be illustrated or represented as a binding sequence, which repeats itself as of the sixth motion cycle in the woven web or fabric according to FIG. 5; the pattern repeat thus encompasses five motion cycles.

When using the method according to the invention with sequences of shed closure angles FSW according to FIG. 4 in a woven web or fabric with a weave pattern draft according to FIG. 5, the partial number Tn1=9 or Tn2=9 of motion cycles in which several shed closure angles FSW form an increasing or decreasing sequence, is greater than the number of motion cycles N=5 that define a weave pattern repeat. By comparing FIGS. 4 and 5 it is clear that several shed closure angles FSW form an increasing or decreasing sequence, which are not influenced by the binding sequence or weave pattern draft. The binding sequence contains the same binding or weave pattern before the increasing or decreasing sequence of shed closure angles FSW as after the increasing or decreasing sequence of shed closure angles FSW. In that regard, in the example according to the FIGS. 4 and 5, it is of no consequence in which motion cycle N of the weave pattern draft the embodiment of the method according to the invention is started.

REFERENCE CHARACTERS

1 woven web or fabric
2 weaving machine
3 main motor
4 shedding device
5 shedding motor
6 shedding element
7 loom shed
8 warp threads
9 control device
10 signals for the synchronization
11 input device
FSW1, FSWn shed closure angle in the motion cycle 1 . . . n
F1, Fn number of shedding element
H stroke of the shedding element
N number of motion cycle
Ng total number of motion cycles
Tn1, Tn2 first, second partial number of motion cycles
W rotational angle of the main shaft of the weaving machine
WB angle of the main shaft of the weaving machine at reed beat-up

The invention claimed is:

1. Method for shed formation on a weaving machine (2), which is driven by a main motor (3), with a shedding device (4), which is driven by a shedding motor (5), wherein, in each motion cycle (N) of the weaving machine (2) a loom shed (7) formed by warp threads (8) of the weaving machine (2) is opened and closed dependent on a weave pattern, and wherein the synchronicity of the two motors (3, 5) is controlled by signals (10) of a control device (9), characterized in that during a partial number (Tn1, Tn2) of motion cycles (N) the synchronicity of the two motors (3, 5) is changed in such a manner so that plural shed closure angles (FSW), at which the loom shed (7) is closed in the respective motion cycles (N) form an increasing or decreasing sequence, and further characterized in that a prescribed total number (Ng) of motion cycles (N) contains both a first partial number (Tn1) of motion cycles (N) in which plural shed closure angles (FSW) form an increasing sequence, as well as a second partial number (Tn2) of motion cycles (N) in which plural shed closure angles (FSW) form a decreasing sequence.

2. Method according to claim 1, characterized in that within the partial number (Tn1, Tn2), the number of the motion cycles (N) in which the shed closure angle (FSW) is changed relative to the respective previous motion cycle (N−1) is greater than 2.

3. Method according to claim 1, characterized in that the prescribed total number (Ng) of motion cycles amounts to not more than 100.

4. Method according to claim 1, characterized in that the following values are prescribed by the operator of the weaving machine (2)

a starting value and an end value of the shed closure angle (FSW) for the increasing or decreasing sequences of shed closure angles (FSW); and a step width that defines the difference of the shed closure angles (FSW) between two successive motion cycles (N).

5. Method according to claim 1, characterized in that the weave patterns of plural successive motion cycles (N) form a binding sequence, which define a pattern repeat, and in that the partial number (Tn1, Tn2) of motion cycles (N) in which plural shed closure angles (FSW) form an increasing or decreasing sequence, is greater than the number of motion cycles (N) that define a pattern repeat.

6. Method according to claim 1, characterized in that the weave patterns of plural successive motion cycles (N) form a binding sequence, and in that the binding sequence consists of the same binding patterns before the increasing or decreasing sequence of shed closure angles (FSW) as after the increasing or decreasing sequence of shed closure angles (FSW).

7. Weaving machine (2) with a main motor (3) for driving the weaving machine (2) and with a shedding device (4) with a shedding motor (5) for driving the shedding device (4) and with a control device (9), with the signals (10) of which the synchronicity of the two motors (3, 5) is controllable, characterized in that a control program is present in the control device (9), which is suitably adapted to carrying out a method wherein, in each motion cycle (N) of the weaving machine (2) a loom shed (7) formed by warp threads (8) of the weaving machine (2) is opened and closed dependent on a weave pattern, and wherein the synchronicity of the two motors (3, 5) is controlled by the signals (10) of the control device (9), characterized in that during a partial number (Tn1, Tn2) of motion cycles (N) the synchronicity of the two motors (3, 5) is changed in such a manner so that plural shed closure angles (FSW), at which the loom shed (7) is closed in the respective motion cycles (N) form an increasing or decreasing sequence and, further characterized in that an input device (11) is present, with which one or more of the following values are inputable by the operator a beginning value and/or end value of the shed closure angle (FSW) of an increasing or decreasing sequence of shed closure angles (FSW);

a step width for an increasing or decreasing sequence of shed closure angles (FSW);

a partial number (Tn1, Tn2) of motion cycles (N) in which plural shed closure angles (FSW) form an increasing or decreasing sequence;

a total number (Ng) of motion cycles (N), which contains both a first partial number (Tn1) of shed closure angles (FSW) in increasing sequence as well as a second partial number (Tn2) of shed closure angles (FSW) in decreasing sequence.

8. Weaving machine (2) according to claim 7, characterized in that the control signals (10) for carrying out the method can be calculated with the control program from the input values.

9. Weaving machine (2) according to claim 8, characterized in that in the calculation of the signals (10), further data present in the control device can be used.

10. Weaving machine (2) with a main motor (3) for driving the weaving machine (2) and with a shedding device (4) with a shedding motor (5) for driving the shedding device (4) and with a control device (9), with the signals (10) of which the synchronicity of the two motors (3, 5) is controllable, characterized in that a control program is present in the control device (9), which is suitably adapted to carrying out a method wherein, in each motion cycle (N) of the weaving machine (2) a loom shed (7) formed by warp threads (8) of the weaving machine (2) is opened and closed dependent on a weave pattern, and wherein the synchronicity of the two motors (3, 5) is controlled by the signals (10) of the control device (9), characterized in that during a partial number (Tn1, Tn2) of motion cycles (N) the synchronicity of the two motors (3, 5) is changed in such a manner so that plural shed closure angles (FSW), at which the loom shed (7) is closed in the respective motion cycles (N) form an increasing or decreasing sequence;

and further characterized in that a prescribed total number (Ng) of motion cycles (N) contains both a first partial number (Tn1) of motion cycles (N) in which plural shed closure angles (FSW) form an increasing sequence, as well as a second partial number (Tn2) of motion cycles (N) in which plural shed closure angles (FSW) form a decreasing sequence.

11. Weaving machine according to claim 10, characterized in that the prescribed total number of motion cycles amounts to not more than 100.

* * * * *